United States Patent [19]

Paul

[11] Patent Number: 4,786,259

[45] Date of Patent: Nov. 22, 1988

[54] LOW PROFILE MODULAR RECEPTACLE AND METHOD OF MAKING SAME

[75] Inventor: Roger L. Paul, Conyers, Ga.

[73] Assignee: Hayes Microcomputer Products, Inc., Norcross, Ga.

[21] Appl. No.: 583,750

[22] Filed: Feb. 27, 1984

[51] Int. Cl.[4] ..... H01R 13/405

[52] U.S. Cl. ..... 439/344; 29/883; 439/358; 439/722; 439/736

[58] Field of Search ..... 339/17 LC, 17 LM, 126 R, 339/176 M, 176 MP, 218 R, 218 M, 125 R; 179/178, 186; 29/883, 884; 264/272.11, 272.14, 272.15

[56] References Cited

U.S. PATENT DOCUMENTS

| | | | |
|---|---|---|---|
| 3,252,206 | 5/1966 | Stevens | 29/884 |
| 3,574,929 | 4/1971 | Michik | 264/272.14 X |
| 3,699,498 | 10/1972 | Hardesty et al. | 339/64 M |
| 3,761,869 | 9/1973 | Hardesty et al. | 339/99 R |
| 3,834,445 | 9/1974 | Raschke | 164/150 |
| 3,839,787 | 10/1974 | Brown et al. | 29/629 |
| 3,850,497 | 11/1974 | Krumreich et al. | 339/126 R |
| 3,860,316 | 1/1975 | Hardesty | 339/91 R |
| 3,895,434 | 7/1975 | Adams et al. | 29/628 |
| 3,990,764 | 11/1976 | Krumreich | 339/176 M |
| 3,998,514 | 12/1976 | Hardesty | 339/99 R |
| 4,148,539 | 4/1979 | Hardesty | 339/99 R |
| 4,188,505 | 2/1980 | O'Conner | 179/1 PC |
| 4,193,654 | 3/1980 | Hughes et al. | 339/17 LC |
| 4,224,485 | 9/1980 | Krumreich | 200/51.1 |
| 4,261,633 | 4/1981 | Abernathy | 339/176 M X |
| 4,268,109 | 5/1981 | Hardesty | 339/205 |
| 4,269,463 | 5/1981 | Beatenbough | 339/99 R |
| 4,269,467 | 5/1981 | Hughes | 339/176 M X |
| 4,343,527 | 8/1982 | Harrington et al. | 339/125 R |
| 4,349,236 | 9/1982 | Guelden | 339/44 M |
| 4,369,340 | 1/1983 | Beatenbough | 179/146 R |
| 4,379,609 | 4/1983 | Hardesty | 339/91 R |

*Primary Examiner*—Gil Weidenfeld
*Assistant Examiner*—Steven C. Bishop
*Attorney, Agent, or Firm*—Jones, Askew & Lunsford

[57] ABSTRACT

A low profile modular telephone receptacle (15) is shown. A unitary housing (16) having a pair of transverse support members (35, 36) is provided. A top plate (17) having the necessary plurality of conductors (20) embedded therein is also provided. During assembly, the ends (22, 25) of the conductor are bent to predetermined angles (62, 65) and the top plate is joined to the bottom plate by ultrasonic welding. The resultant receptacle is one in which a minimum height dimension (h) above the necessary height dimension of the opening (18) to accept a standard modular plug is provided. In the preferred method of construction, the top plates (17) are injection molded onto continuous strands of filaments to form the conductors (20). A plurality of slots (55, 56) are provided at one end of the top plate to guide the conductors corresponding openings (46) in the bottom plate when the ends of the conductors forming a terminal set for connecting the receptacle to a utilization circuit are fabricated.

6 Claims, 3 Drawing Sheets

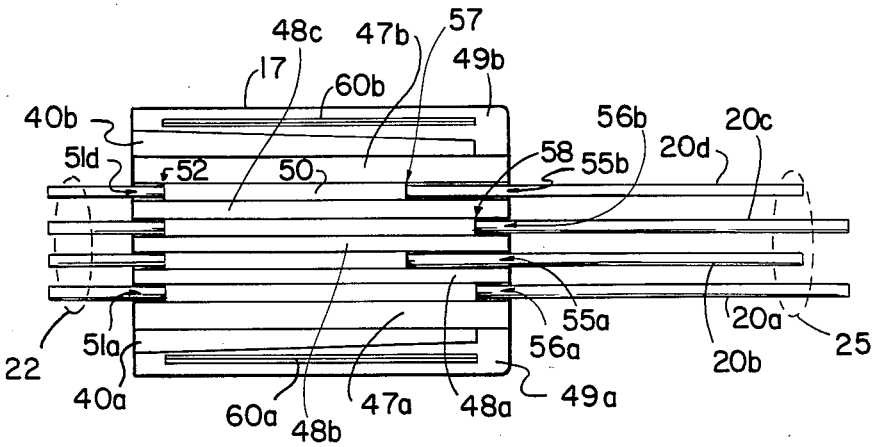
Fig. 6
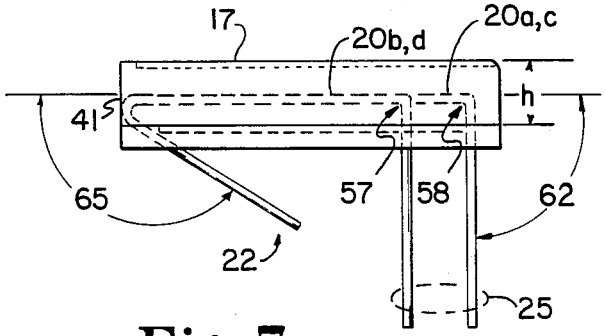
Fig. 7
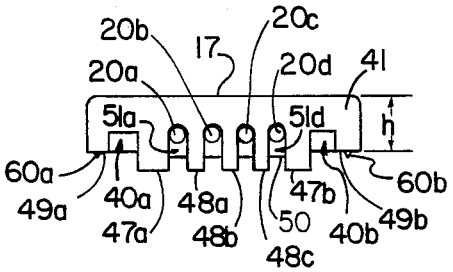
Fig. 8
Fig. 9
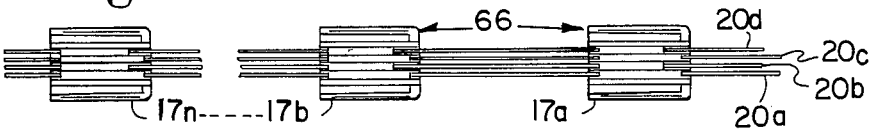

LOW PROFILE MODULAR RECEPTACLE AND METHOD OF MAKING SAME

TECHNICAL FIELD

The present invention is in the field of electronic connectors and specifically discloses a receptacle for standard modular telephone plugs. The present invention is specifically designed to be useful in applications wherein a modular receptacle is mounted on a printed circuit board and it is important to keep the height of components above the plane of the circuit board to a minimum.

BACKGROUND OF THE INVENTION

Since the early 70s, standard modular plug/receptacles have become a standard arrangement for connecting telephones to subscriber lines in the United States. Most people are now familiar with the modular plug, for example, of the type shown in U.S. Pat. Nos. 3,761,869 and 3,860,316. While there are several forms of the standard plug, the RJ11 type is probably the one with which most telephone subscribers are familiar.

Also, the last decade has seen a tremendous growth in the use of computers in industrialized countries throughout the world. Improvements in integrated circuit technology have led to a continuing decline in the price of computers. When the home or small business computers of today are compared with the computers of 10 to 15 year ago, it becomes apparent that the price of equivalent computing power has dropped approximately two orders of magnitude in a relatively short span of time.

The great proliferation of computers has led to a corresponding proliferation in the number of modems used in the United States and throughout the world. As is known to those skilled in the art, and most users of computers, modems (a contraction for modulator/-demodulator) are devices which convert digital signals from a computer or terminal into a modulated signal appropriate for transmitting over telephone lines. Most modems for use in home computers use a modulation technique which is appropriate for the transmission of data within the relatively narrow passband of a standard, unconditioned, telephone line such as that normally found in the home.

As modular plugs/receptacles have become standard connection devices for connecting customer equipment to telephone lines, standard modular receptacles are normally found on modems being manufactured today for use in the United States.

Several very popular small computers in use today have a hardware architecture by which peripheral devices are connected to expansion slots on the mother board of the computer, as opposed to serial or parallel output ports being provided to the user. The expansion slot architecture allows a great deal of flexibility in the design of peripheral devices which can be connected to such computers. Additionally, the use of expansion slots allows the use of standard card sizes for the circuit boards upon which peripherals are constructed. A number of peripherals or expansion devices may be inserted into the expansion slots and the normal cover for the computer can be replaced. This arrangement allows the user to expand the capabilities of the computer without a corresponding expansion of the number of boxes and cables lying about at the computer installation site.

In the marketing of many small computers, a trade-off is necessary between the physical size of the computer and the number of expansion slots made available to the user. Users desire more and more expansion slots but, at the same time, there is a need to keep the size of the computer manageable. This, coupled with additional advances in circuit density through LSI and VLSI techniques, has led to designs in which expansion slots are relatively close together in many popular small computers. The close spacing of expansion slots results in a requirement that the profile of components placed on the circuit board be kept to a minimum. As used herein, the term profile refers to the physical height above the component side of a circuit board.

A confluence of all of the factors mentioned above has led to a great popularity of modems which are constructed on a single circuit board for insertion into an expansion slot of a small computer. A modular receptacle for connecting the modem to the telephone line is provided on the circuit board and is normally accessible through a back panel segment provided on the peripheral card.

As expansion slots are moved closer together, and less clearance is available between peripheral cards to be plugged into expansion slots, it has been found by the inventor of the present invention that available modular receptacles were too high for use in certain applications. In other words, the use of prior art modular receptacles on a circuit board modem designed to be plugged into an expansion slot was not practical, because the profile of the prior art modular receptacles was too high, and the user would be unable to insert another peripheral device into an adjacent expansion slot.

The particular application which led to the creation of the present invention was the slight narrowing of the back panel space which resulted from a design modification of the popular IBM personal computer to the IBM XT personal computer. However, the trend noted above is common throughout the industry, and the present invention will find applications in many other devices requiring low profile modular receptacles.

Naturally, the size of the opening required for acceptance of a standard modular plug places a lower limit on the profile that a printed circuit board mounted modular plug may have. However, it was discovered by the inventor of the present invention that the prior art did not provide a modular receptacle, that could be used for circuit board mounting, which effectively minimized the profile of the receptacle above the component side of the board. Thus there is a need in the art for an inexpensive modular receptacle which may be mounted on a printed circuit board which effectively minimizes the profile of the receptacle assembly above the plane of the board.

SUMMARY OF THE INVENTION

The present invention overcomes the above-noted problem in the prior art by providing a low profile modular plug which may be easily manufactured and is of simple construction. The structure of the present invention provides an arrangement which effectively minimizes the profile of a modular receptacle and is particularly suited for mounting on a printed circuit board.

The apparatus may be readily manufactured by the injection molding of two pieces of plastic which are then joined together, preferably by ultrasonic welding.

The structural apparatus of the present invention is such that the incremental increase in height required for the modular receptacle, over and above the height determined by the opening required to accent a standard modular plug, is limited only by the thickness of material necessary to carry the conductors which mate with the conductors of the modular plug. In the method of the present invention, a top plate is formed integrally with a plurality of elongated conductive filaments which eventually form the conductors of the resultant receptacle. The top plate is molded around the conductive filaments so that the resulting structure is one in which the conductors of the receptacle are embedded within the top plate. By the adoption of this method, the contribution to the height of the overall receptacle from the top plate can be held to a minimum since the thickness of the top plate need only be sufficient to physically secure the embedded conductors.

In the present invention a housing having a bottom plate and a pair of side walls is provided. At least one transverse support member is provided which serves the dual function of physically securing the side walls and retaining the conductors of the receptacle in a predetermined alignment.

Preferred forms of the present invention include a plurality of openings, which may be either slots or holes, in the bottom plate through which one end of the conductors are passed to form a terminal set by which the conductors can be connected to a utilization device. Another feature of the preferred form of the invention is to provide a set of corresponding slots below the conductors in the top plate such that the mathematical projection of the slots in the top plate onto the bottom plate is substantially coextensive with the openings in the bottom plate. This arrangement assures that the conductors are guided by the slots, in response to being bent downwardly, so that they line up with the openings in the bottom plate. Thus, it is an object of the present invention to provide a low profile modular receptacle for a modular telephone plug. It is a further object of the present invention to provide such a modular receptacle which is particularly suited for mounting on a printed circuit board for which component height above the board must be kept to a practical minimum.

It is a further object of the present invention to provide a method of constructing such a modular receptacle which is extremely simple and can be implemented by injection molding of two pieces of plastic which are then assembled. It is a further object of the present invention to provide an improved modular receptacle in which the conductors are physically embedded in the structure of a top plate, and in which a plurality of slots are provided below the conductors at one end of the top plate. The slots guide the ends of the conductors toward a corresponding set of openings in the bottom plate of the receptacle to form a terminal set by which the receptacle may be connected to a utilization device.

It is a further object of the present invention to provide a modular receptacle in which the height of the receptacle above a surface upon which it is mounted is determined by a standard opening size for the plug to be inserted into the receptacle and the thickness of material forming a top plate which is necessary to physically secure the conductors. That the present invention meets the foregoing objects, and overcomes the above-noted drawbacks of the prior art, will become apparent from the following detailed description.

BRIEF DESCRIPTION OF THE DRAWINGS

FIG. 6 is a bottom plan view of the top plate of the preferred embodiment.

FIG. 7 is a side elevational view of the top plate of the preferred embodiment.

FIG. 8 is a front plan view of the top plate of the preferred embodiment.

FIG. 9 is a pictorial view of a plurality of the top plates and elongated conductive filaments which are provided as one step in the preferred embodiment of the method of the present invention.

DETAILED DESCRIPTION

Figure 1:
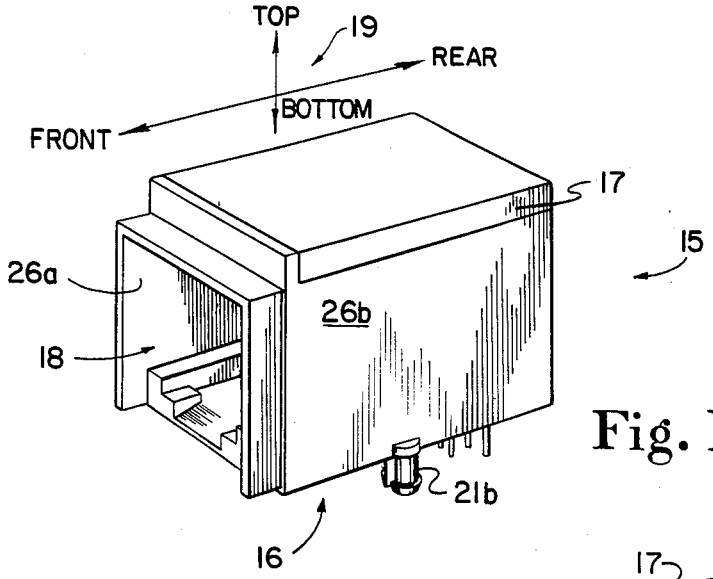
FIG. 1 is a pictorial view of the preferred form of the apparatus of the present invention.
Figure 1A:
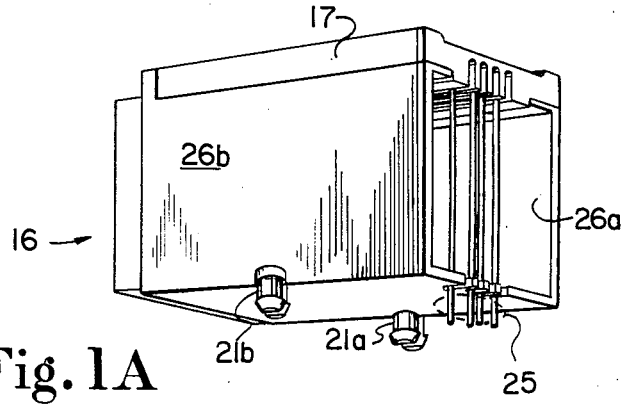
FIG. 1A is a pictorial view of the preferred form of the apparatus of the present invention.

Turning next to the drawing figures in which like numerals represent like parts, the preferred embodiments of the apparatus and method of the present invention will now be described. A preferred embodiment of the apparatus of the present invention is a low profile modular receptacle shown generally as 15. The embodiment is constructed from a housing 16 and a top plate 17. The resulting apparatus includes a conventional opening, shown as 18, for receiving a standard modular plug.

In order to define the nomenclature used in the present specification, a set of axes is shown as 19 in FIG. 1. Axes set 19 defines front, rear, top and bottom directions as those terms will be used herein. Furthermore, it should be understood that, as used in the present description, the longitudinal axis of the preferred embodiment is parallel to the front/rear axis shown in set 19 and the transverse direction is perpendicular to both of the axes shown in FIG. 1.

Also, as used throughout the specification, structural elements which have corresponding left and righthand members due to the bilateral symmetry of the preferred embodiment along the longitudinal axis will bear identical reference numerals followed by lower case letters of the alphabet. Thus, references to mounting studs 21 should be understood to refer to both the lefthand (as the device is viewed from the front) mounting stud 21*a*, and righthand mounting stud 21*b*.

Figure 2:
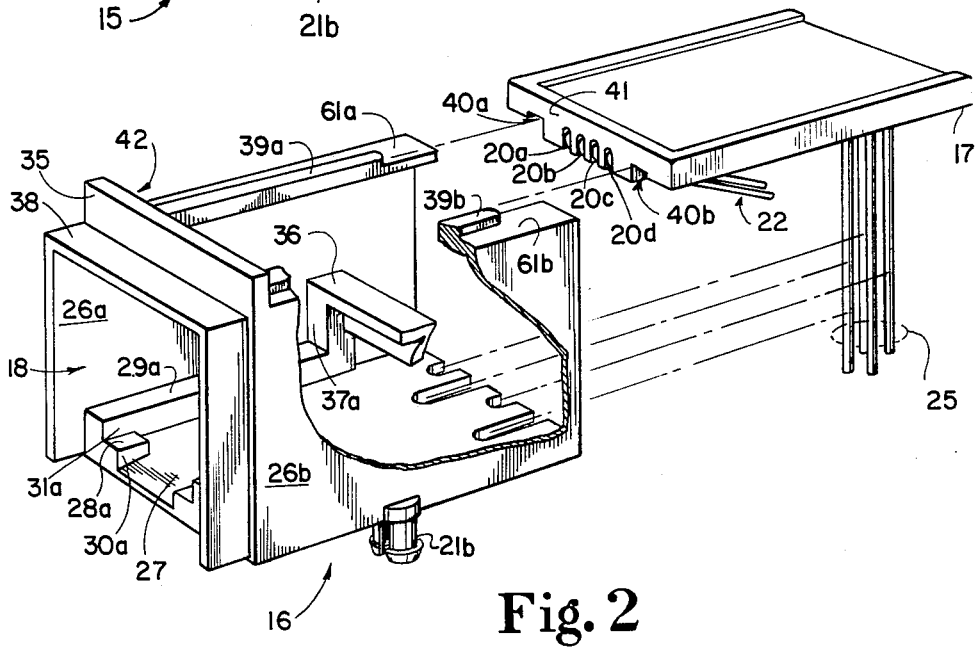
FIG. 2 is an exploded view of the preferred embodiment showing the top plate and of the housing prior to final assembly.

As may be seen in FIG. 2, a plurality of conductors 20*a*—20*d* are provided in the preferred embodiment. A pair of mounting studs 21 (one being shown as 21*b* in FIGS. 1 and 2) is provided in a conventional manner. These mounting studs are conventional in nature and are inserted through holes in a surface upon which the preferred embodiment is to be mounted to physically secure the device to the surface.

The front ends of conductors 20 are shown as 22 in FIG. 2, while the rear ends of the conductors are shown as 25. It will be appreciated that rear ends 25 form circuit connector ends, which in turn form a terminal set for connecting conductors 20 to a utilization circuit in which the present invention will be used.

Housing 16 is constructed from a bottom plate 27 and a pair of side walls 26 as may be seen in FIGS. 1 and 2. A set of steps 28 and 29 forming corresponding side surfaces 30 and 31 are provided above bottom plate 27. These form the interlock and guiding surfaces for a standard RJ11 type modular plug. The structure and dimensions of these elements are well known to those skilled in the art and require no further explanation.

A first transverse support member 35 is provided at the front of the housing. As is apparent from FIGS. 1 and 2, at least a portion of transverse member 35 extends above side walls 26.

A second transverse member 36 extends between side walls 26 and is behind and below first transverse member 35. In the preferred embodiment, transverse support member 36 is supported by an integrally formed pair of legs 37 extending between bottom plate 27 and member 36. In the preferred embodiment, a hood 38 extends out in front of side walls 26 and transverse support member 35.

A pair of integrally formed tongues 39 is positioned on top of side walls 26. Tongues 39 mate with grooves 40 in top plate 17 when the preferred embodiment is assembled. It will further be appreciated that front elevational surface 41 of top plate 17 abuts the rearward elevational surface 42 (FIGS. 1 and 5) of transverse support member 35 when the device is assembled.

Figure 3:
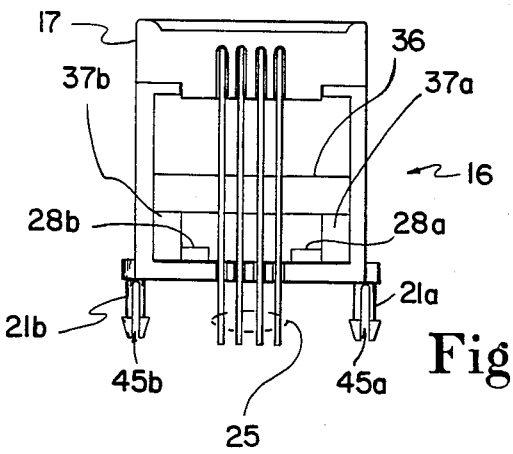
FIG. 3 is a near elevational view of the preferred embodiment of the apparatus of the present invention.

Turning next to FIG. 3, a rear elevation of the assembled receptacle of the preferred embodiment is shown. FIG. 3 shows that a pair of notches 45 are provided in a conventional manner in mounting studs 21 so that the sides of studs 21 may be compressed during insertion through a set of holes in a mounting surface.

Figure 4:
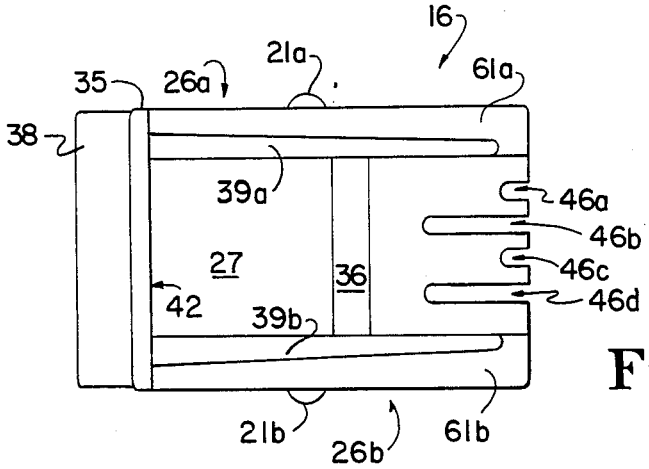
FIG. 4 is a top plan view of the housing component of the preferred embodiment.

Turning next to FIG. 4, a top plan view of housing 16 is shown. It should be understood that the preferred form of the present invention is one in which tongue members 39 are slightly tapered between their front and rear ends. In the preferred embodiment, a half degree taper, with respect to the longitudinal axis of the plug, is used. As is explained in connection with FIG. 7 below, a corresponding taper is provided in grooves 40. When the device is assembled, top plate 17 is slidably mounted onto the top of housing 16 so that tongues 39 engage grooves 40. The geometry of these elements causes ends 22 to the conductor to be properly aligned with opening 18 when the receptacle is assembled. The slight taper provided to these elements assures that the tongue and groove structures will easily mate and provide an additional friction fit when top plate 17 is fully advanced to the position shown in FIG. 1.

Another important feature of the preferred embodiment of the present invention is shown in FIG. 4. A plurality of openings, preferably embodied as slots 46, are provided in bottom plate 27. Circuit connector ends 25 of conductors 20 pass through slots 46 since these ends of the conductors are bent downwardly. Of course, corresponding openings in the form of holes could be provided in the construction of an embodiment of the present invention, but slots 46 are the preferred form since ends 25 may slide into slots 46 from the rear end of the bottom plate.

Figure 5:
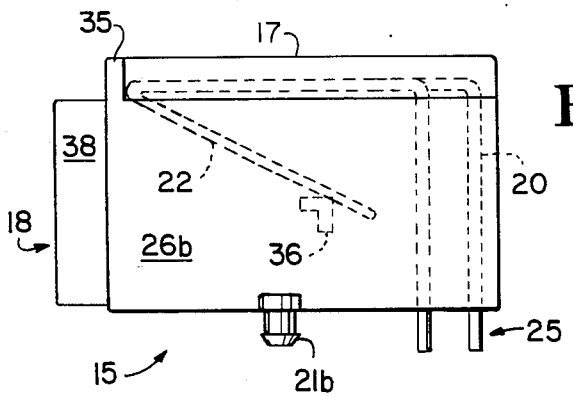
FIG. 5 is a side elevational view of the preferred embodiment showing the conductors in phantom.

FIG. 5 is a side elevational view of the preferred embodiment, as assembled. Portions of conductors 20 are shown in phantom in FIG. 5. Front ends 22 are bent downwardly and backwardly prior to assembly so that these ends rest on the top of transverse support member 36. As will be explained in connection with FIG. 7 below, front ends 22 are bent to an angle within a predetermined range of angels so that their natural resiliency exerts spring pressure on the top of transverse support member 36.

Turning next to FIGS. 6–8, details of the construction of top plate 17, with conductors 20 embedded therein, are shown. First, turning to FIG. 6, the inside edges of slots 40 are defined by main partitions 47. The relative depth of partitions 47 with respect to surfaces 49, as well as the relative depth of grooves 40 with respect to surfaces 49, may be appreciated from viewing FIG. 6 in conjunction with FIG. 8. Conductors 20 are embedded within the plastic material from which top plate 17 is constructed. The depth of material under conductors 20 in the space between partitions 48 is defined by a recessed surface 50 shown, by way of example, as lying under conductor **20*d***.

One side of each of main partitions 47, and partitions 48, form a plurality of slots 51 in the front end of top plate 17 below conductors 20.

It should be noted that the longitudinally extending conductors 20 shown in FIGS. 6 and 8 represent a first step in assembly of the entire preferred embodiment. As will become apparent from the complete description of construction given hereinbelow, conductors are provided embedded in top plate 17 and extending longitudinally therefrom as shown in FIGS. 6 and 8. During the construction process, the front ends 22 of the conductors are bent downwardly and rearwardly as shown, for example, in FIG. 5. Slots 51 have co-linear rear walls shown at position 52 in FIG. 6.

Thus, it will be appreciated from viewing FIGS. 6 and 8 that as front ends 22 of conductors are bent downwardly, slots 51 (which are formed by partitions 47 and 48) will serve to guide conductors 20 so that the front ends 22 will remain equally spaced as appropriate for a standard modular receptacle. Further downward and backward bending to the position shown in FIG. 5 will still allow partitions 47 and 48 to guide the conductors.

Toward the rear end of top plate 17, a further set of slots between the aforementioned partitions is provided. The preferred form of the set of slots is shown in FIG. 6, wherein slots 55 are recessed toward a back termination wall shown at position 57, and slots 56 terminates at a wall shown at position 58. Slots 55 lie under conductors **20*b* and 20*d* while slots 56 lie under conductors 20*a* and 20*c*. In viewing FIG. 6 in conjunction with FIG. 7, it can be seen that when circuit connector ends 25 are bent downwardly, as shown in FIG. 6, conductors 20*b* and 20*d* will have a resultant position which is forward of conductors 20*a* and 20*c***.

It should also be noted that conductors **20*b* and 20*d* have shorter rear ends than conductors 20*a* and 20*c* (FIG. 6). The difference in the length of these conductors corresponds to the distance along the longitudinal axis of the receptacle between points 57 and 58 defining the ends of slots 55 and 56, respectively. Thus, circuit conductor ends 25 will line in substantially the same plane when bent downwardly at approximately 90° as shown in FIG. 7**. This facilitates mounting the assembled receptacle onto a circuit board or similar surface.

Furthermore, viewing FIGS. 6 and 7 in conjunction with FIG. 4, it will be appreciated that, in the assembled receptacle, the mathematical projection of slots 55 and 56 downwardly onto bottom plate 36 is substantially coextensive with slots 46 shown in FIG. 4. Thus, it will be appreciated that when circuit connector ends 25 of the conductors 20 are bent downwardly the rear walls at positions 57 and 58 of slots 55 and 56, respectively, guide ends 25 through openings 46 in bottom plate 36.

The preferred form of the present invention is one in which circuit connector ends 25 form two resultant pairs of longitudinally offset terminals. However, it will be readily appreciated that any arrangement wherein openings (corresponding to openings 46) in the bottom plate 27 are substantially identical to the downward projection of the slots (corresponding to slots 55 and 56) in top plate 17, is one in which the conductors will be guided through the openings in the bottom plate. Thus, such arrangements may be used to construct embodiments of the present invention.

Viewing FIGS. 2 and 8 together, it will be appreciated that the height which the resultant modular plug must extend above the predetermined height of opening 18 (which is defined by the dimensions of a standard modular plug) is the dimension shown as "h" in FIGS. 7 and 8. In the preferred embodiment of the present invention (an RJ11 type receptacle), dimension h is equal to 0.12 inches. The necessary thickness of the material used in construction of top plate 17 is a function of the strength of the material used, and the torsional spring modulus of the material selected for conductors 20. However, it may be seen that, within limits, the relative position of bottom surface 50 below the centers of conductors 20 may be varied without increasing dimension h.

Furthermore, it is believed by the inventor that workable embodiments of the present invention in which dimensions h is reduced may also be constructed providing an even lower profile for the resultant receptacle. Naturally, it is preferable to have the height of transverse support member 35 (FIGS. 1 and 2) be coextensive with the upper surface of top plate 17.

Also shown in FIGS. 6 and 8 are ridges 60. Ridges 60 have a cross section as shown in FIG. 8. It will be appreciated from inspection of FIGS. 2 and 8 that ridges 60 engage top surfaces 61 of side walls 26 when top plate 17 is placed over housing 16. In the preferred embodiment of the present invention, ridges 60 provide a source of melted plastic to form the necessary weld between surfaces 49 and 61 during the step of assembly by ultrasonic welding. As will be known to those skilled in the art, structures such as ridge 60 are sometimes referred to as energy directors in connection with plastic parts to be ultrasonically welded together.

Returning to FIG. 7, a side elevational view of top plate 17, prior to assembly with housing 16, is shown. Circuit connector ends 25 of conductors 20 are bent downwardly at an angle shown as 62 in FIG. 7. In the preferred form of the present invention, angle 62 lies within a predetermined range of angles between 90° and 95°. In viewing FIG. 7 in connection with FIGS. 4 and 5, it will be appreciated that this range of angles will cause conductors 20 to slide toward the front end of slots 46 (FIG. 4). If the rear ends of the wires are bent to an angle in excess of 90°, they will be urged slightly toward the front end of slots 46 and will remain secure in this position. Thus, it will be appreciated that the resulting configuration, having circuit connector ends 25 and mounting studs 21 produces a receptacle which is appropriate for automatic insertion onto a circuit board, thus speeding the production process of the utilization device in which the present invention is used.

The front ends 22 of conductors 20 are bent downwardly and rearwardly to an angle shown as 65 in FIG. 7. From inspection of FIGS. 5 and 6, it will be appreciated that angle 65 must be less than or equal to the resulting angle of front ends 22 (shown in FIG. 5) when the receptacle is fully assembled. It is preferred to have the angle to which ends 22 are bent to be something less than the final resultant angle of the wires in the fully assembled receptacle so that spring pressure is provided by the conductors urging them down on the top surface of transverse support member 36 (FIG. 5). The inventor has discovered that the preferred range of angles for angle 65 to which front ends 22 are bent during fabrication is 145° to 156°.

Turning next to FIG. 9, as well as the other figures discussed hereinabove, the construction method of the present invention will now be described. It is a particular advantage of the present invention that conductors 20 are embedded within top plate 17. As shown in FIG. 9, the preferred method of fabricating the top plate assembly (FIGS. 6–8) is to provide four parallel continuous conductive filaments from which conductors 20 will be formed. Since the elongated conductive filaments are identical to conductors 20, they are referenced with the numeral 20 in connection with FIG. 9. A plurality of top plates are described in connection with FIGS. 6–8 above are molded over conductive filaments 20 and are shown as plates 17*a*—17*n* in FIG. 9. A length of conductive filaments 20 between contiguous ones of top plate 17 is shown as 66 in FIG. 9.

It will be appreciated by those skilled in the art that plastic materials may be very rapidly molded over conductive filaments to produce a continuous assembly of top plates 17 having conductive filaments embedded therein as shown in FIG. 9. In the preferred form of the present invention, the molded plastic materials are made of virgin polycarbonate, although other moldable materials may be used in practicing the construction method of the present invention.

Housing 16, as shown in FIGS. 2 and 4, is injection molded in a single step from a multi piece mold in a manner which will be familiar to those skilled in the art. The next step is to separate the plurality of plates 17 by cutting conductive filaments 20 at approximately the midpoint between contiguous top plates 17. The next step is to cut additional material from conductors 20*b* and 20*d* so that the relative lengths of these two conductors with respect to conductors 20*a* and 20*c* is as shown in FIG. 6.

It will be appreciated by those skilled in the art that interplate lengths 66 (FIG. 9) may be selected, and a multi surface cutting tool may be used, so that front ends 22 of conductors 20 are cut evenly and rear ends 25 are cut in the staggered fashion shown in FIG. 6, in one step. Of course, the method of the present invention can be practiced in a manner in which conductive filaments 20 are cut evenly and the lengths of circuit connector ends 25 are cut to be even after assembly so that the result is as shown in FIGS. 2 and 7. Also, embodiments of the apparatus of the present invention may be constructed in which some of circuit connector ends 25 are left longer than others.

Turning back to the preferred method of the present invention, the next step is to bend both ends 22 and 25 of conductors 20 downwardly to angles within the two predetermined ranges of angles described in connection with FIG. 7. When this step is completed, the top plate assembly is then inserted onto the top of housing 16 as illustrated in FIG. 2. When this is completed, top plate 17 and housing 16 are secured together, preferably by ultrasonic welding. Of course, other methods of securing top plate 17 to housing 16, such as glueing, conventional heating or the like may be used, but the inventor believes that the step of ultrasonic welding is included in the best mode of practicing the method of the present invention.

In view of the foregoing description, and the teachings of this specification, other embodiments of the present invention will suggest themselves to those skilled in the art. From the foregoing description, it will be appreciated that the present invention overcomes the aforementioned drawbacks in the prior art and accomplishes the objects of the invention set out above. Thus, the scope of the present invention is to be limited only by the claims below.

I claim:

1. A low profile modular receptacle for modular telephone plugs comprising in combination:

a housing comprising a pair of side walls, a bottom plate connected to said side wall, said bottom plate including a plurality of slots in the rear end thereof;

a first transverse support member extending between said side walls and including a portion extending above said side walls;

a second transverse support member extending between said side walls below said first transverse support member and forward of a rear end of a top plate;

said top plate being constructed of an electrical insulating material engaging said first transverse support member and connected to said side walls;

a plurality of longitudinally extending elongated conductors embedded in said top plate so as to be completely surrounded by said insulating material over a substantial portion of the entire length of said top plate and so that said insulating material forming the upper surface of said top plate completely covers said conductors; the rear ends of said plurality of conductors being bent downwardly and engaging said plurality of slots in said bottom plate, said top plate including a plurality of slots below said plurality of conductors characterized by a projection onto said bottom plate substantially equal to said plurality of slots in said bottom plate;

the front ends of said plurality of conductors being bent downwardly and backwardly behind said second transverse support member and being urged against the top of said second transverse support member.

2. A receptacle as recited in claim 1 further comprising a pair of spaced apart mounting studs extending downwardly from said bottom plate.

3. A method of constructing a modular receptacle comprising the steps of:

forming a housing comprising a bottom plate, said bottom plate including a plurality of openings in a rear portion thereof, a pair of side walls connected to said bottom plate, a first transverse support member extending between said side walls and including a portion extending above said side walls, and a second transverse support member extending between said side walls below said first transverse support member;

providing a plurality of elongated conductive filaments;

molding a plurality of top plates onto said plurality of elongated conductive filaments so that said filaments are embedded within said plurality of top plates and are extended longitudinally from each end of said plurality of top plates;

cutting said plurality of elongated filaments between each of said top plates to provide said top plate having a plurality of conductors embedded therein, the remaining portions of said elongated conductive filaments forming said plurality of conductors;

providing a set of slots at each end of said top plate below said plurality of conductors for guiding said plurality of conductors into a predetermined spatial relationship in response to said plurality of conductors being urged downwardly;

bending the rear ends of said plurality of conductors downwardly to a first angle within a first predetermined range of angles;

bending the front ends of said plurality of conductors downwardly and backwardly to a second angle within a second predetermined range of angles;

placing said top plate over said housing in engagement with said first transverse support member and said pair of side walls guiding said rear ends of said plurality of conductors into said plurality of openings and guiding said front ends of said plurality of conductors so as to be urged against said second transverse support member; and securing said top plate to said housing.

4. A method as recited in claim 3 wherein said step of securing said top plate to said housing includes a step of ultrasonically welding said top plate to said housing.

5. A method as recited in claim 3 wherein said step of forming said housing is accomplished by injection molding of polycarbonate plastic.

6. A method as recited in claim 3 wherein said step of providing said top plate is accomplished by injection molding of polycarbonate plastic.

* * * * *